United States Patent [19]

Dunford

[11] Patent Number: 4,742,579

[45] **Date of Patent: * May 10, 1988**

[54] SKI GLOVE

[75] Inventor: Scott Dunford, Salt Lake City, Utah

[73] Assignee: Skiears, Inc., Salt Lake City, Utah

[ * ] Notice: The portion of the term of this patent subsequent to Oct. 13, 2004 has been disclaimed.

[21] Appl. No.: 18,405

[22] Filed: Feb. 25, 1987

Related U.S. Application Data

[63] Continuation-in-part of Ser. No. 926,001, Oct. 31, 1986, Pat. No. 4,698,851.

[51] Int. Cl.[4] ..... A41D 19/00

[52] U.S. Cl. ..... 2/160; 2/161 A

[58] Field of Search ..... 2/158, 159, 160, 161 R, 2/161 A, 163, 161

[56] References Cited

U.S. PATENT DOCUMENTS

| | | | |
|---|---|---|---|
| 792,662 | 6/1905 | Liebenstein | 2/161 R |
| 922,237 | 5/1909 | Baggett | 2/161 R |
| 945,818 | 1/1910 | Sprague | 2/161 R |
| 2,581,549 | 1/1952 | McGaugh | 2/161 R |
| 2,685,021 | 7/1954 | Duncan | 2/158 |
| 3,170,703 | 2/1965 | Marchand | 2/160 X |
| 3,232,632 | 2/1966 | Lewis | 2/160 X |
| 3,632,966 | 1/1972 | Arron | 2/158 X |
| 4,081,864 | 4/1978 | Liman | 2/161 A |
| 4,281,418 | 8/1981 | Cieslak et al. | 2/160 |
| 4,535,482 | 8/1985 | Spector et al. | 2/160 |
| 4,653,121 | 3/1987 | Kassal | 2/161 A |

*Primary Examiner*—Louis K. Rimrodt

*Attorney, Agent, or Firm*—Thorpe, North & Western

[57] ABSTRACT

A glove covering for use in winter sports for protecting a hand against cold weather, comprising an outer glove shell which includes a finger section, thumb section, palm/wrist section and pocket for a flexible heater pack. Pocket members are attached at the finger and thumb sections to allow insertion of a user's fingers and thumbs within the pockets. The palm/wrist section of the shell is open and provides a pocket structure for holding the heater pack in an insulated location to retain generated warmth at the contained glove or hand. A single glove structure is also shown with a heater back secured within a pocket to provide a heat source to the wearer.

18 Claims, 1 Drawing Sheet

SKI GLOVE

This is a continuation-in-part of application Ser. No. 06/926,001 filed Oct. 31, 1986, now U.S. Pat. No. 4,698,851 granted Oct. 3, 1987.

BACKGROUND OF THE INVENTION

1. Field of Invention:

This invention relates to cold weather gloves for providing protection to the hands against adverse weather conditions. More particularly, the invention pertains to a glove adapted for use with a reusable heater packet over a conventional glove to increase the degree of warmth and protection to the hand.

2. Prior Art:

A variety of glove designs have been developed for protecting the hands in cold weather sports. Typical of the more extreme conditions is the sport of skiing. Because the hands are used during skiing activities, the glove represents the only protection against cold weather. Such cold weather conditions do not remain uniform, but vary even during the course of the day.

During early morning hours when cold weather conditions are most severe, even the best of gloves may be inadequate to protect the hands. As the day warms up, however, the same pair of gloves will be adequate, or may even be too warm In such cases, the skier must decide whether to return to the lodge and change gloves, to remove the gloves and go without, or to continue to wear the gloves and to be too warm. Typically, a skier finds it too cumbersome to carry more than one pair of gloves, despite the fact that he would be more comfortable with increased warmth during cold morning hours and less glove warmth as the day progresses.

OBJECTS AND SUMMARY OF THE INVENTION

It is therefore an object of the present invention to provide a type of ski glove with a separate heat source which can be worn alone or in combination with other ski gloves as a second covering, but which is small enough to allow easy storage in a coat pocket during warmer weather.

It is a further object of the present invention to provide a glove covering which can be activated to generate heat, but which does not require use of bulky hardware such as a conventional hand warmer.

It is a still further object of this invention to provide a separate source of heat which adds warmth to the hand when used as part of a full glove or mitten without significantly adding to the bulk of the glove.

A still further object of the present invention is to provide a glove covering which includes a heat source operable at the will of the wearer but which may also be used with or without an interior full glove to protect the hands from mildly cold weather.

These and other objects are provided in a glove covering for use in winter sports which comprises an outer glove shell, at least one first pocket member for fingers and a second pocket member for the thumb. The outer glove shell is configured in size and shape to fully cover only a back side of the hand and has a length extending from a forward fingertip end to a rearward wrist end. The outer glove shell includes at least one finger section, a palm/wrist section and a thumb section. At least one pocket member is configured in the approximate shape of the finger section and is joined therewith to form a pocket having an opening accessible from the palm/wrist section for insertion of fingers of the hand. An additional pocket is provided in the outer glove shell in the finger and/or palm/wrist section and includes a pocket opening to permit insertion of a reusable heater packet therein.

A second pocket member formed in the approximate configuration of the thumb section of the glove shell is attached around the perimeter thereof with an unattached section at the approximate juncture of the palm/wrist and thumb sections to form a pocket opening for the thumb. A strap may be attached to the shell for securing the glove around the wrist. Other modifications are also disclosed.

A mitten configuration is also shown which includes a heater pocket between an exterior face and inner glove lining to provide a supplemental heat source within the glove which may be activated at the discretion of the wearer.

Other objects and features of the present invention will be apparent to those skilled in the art, based on the following detailed description, taken in combination with the following drawings, wherein.

DETAILED DESCRIPTION OF THE INVENTION

Figure 1:
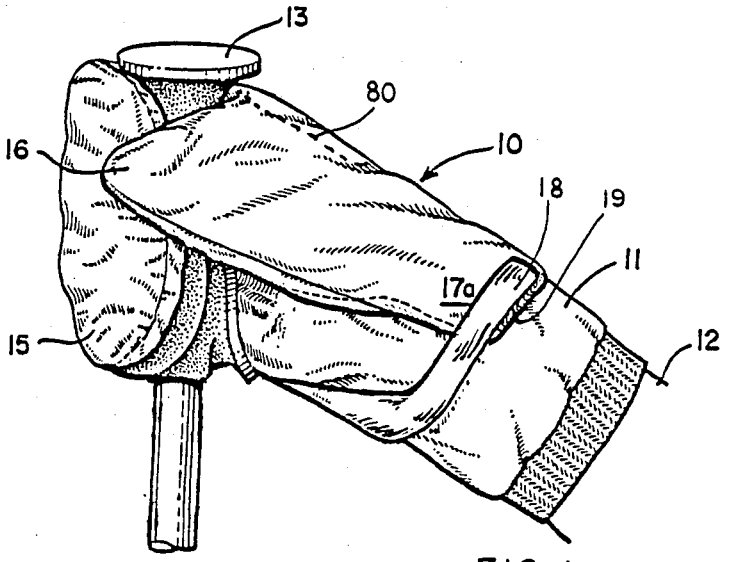
FIG. 1 shows a perspective view of the subject invention being worn over a ski glove, with the wearer gripping a ski pole.

Referring now to the drawings:

FIG. 1 discloses a glove covering 10 which is worn over a conventional ski glove 11 by a user 12 who is illustated with a grip on a ski pole 13. One application of the present invention is to provide additional weather protection to the user by adding insulation and covering over a conventional ski glove 11. This covering includes an outer glove shell 14 which is divided into three parts. These parts include a finger section 15, a thumb section 16 and a palm/wrist section 17. A strap 18 extends from the palm/wrist section 27 and provides means for securing the glove 10 around the wrist by means of VELCRO (TM) 19.

The primary structure of this glove covering comprises the outer glove shell 14 which forms the foundation to which the remaining structure is attached. The shell is configured in size and shape to cover the back side of the hand and/or ski glove for providing increased insulation and protection against the weather. Typically, this shell will comprise a layer of insulative material 20 which is sandwiched between exterior protective coverings 21 and 22. Typically these coverings will comprise a decorative fabric which is both water resistant or water proof and fashionable. The interior insulation 20 may be structured of THINSULATE (TM) or other materials which provide high insulative properties without extreme thickness. These three components are sewn together at a perimeter 24 to form a single, composite sheet or member.

This shell is generally divided into three sections, based upon the functional aspect of each particular section. Because of the functional definition of each of these three areas, it is not intended to segregate the covering into three actual boundary conditions. Instead, the division of the shell into three parts is to enable definition of three separate components of the glove covering to simplify further explanations in this disclosure. These three sections are provided in rough division by dashed lines 30, 31 and 32. Again, these dashed lines are figurative and do not actually mark a boundary for the specific three areas. However, the dashed lines are useful to perceive the definition applied to these respective areas as set forth in the claims hereafter.

The finger section 15 of the glove shell comprises that part of the shell which is positioned at the fingers of the glove or hand contained therein. Obviously, a clear demarcation of this border is unnecessary because hand sizes differ and will require differing dimensions for various sizes of gloves. Nevertheless, one skilled in the art will be able to identify that portion of the glove shell which comprises the finger section. It extends from a fingertip end 25 to line 31, or that area where the fingers meet the palm of the hand.

Figure 2:
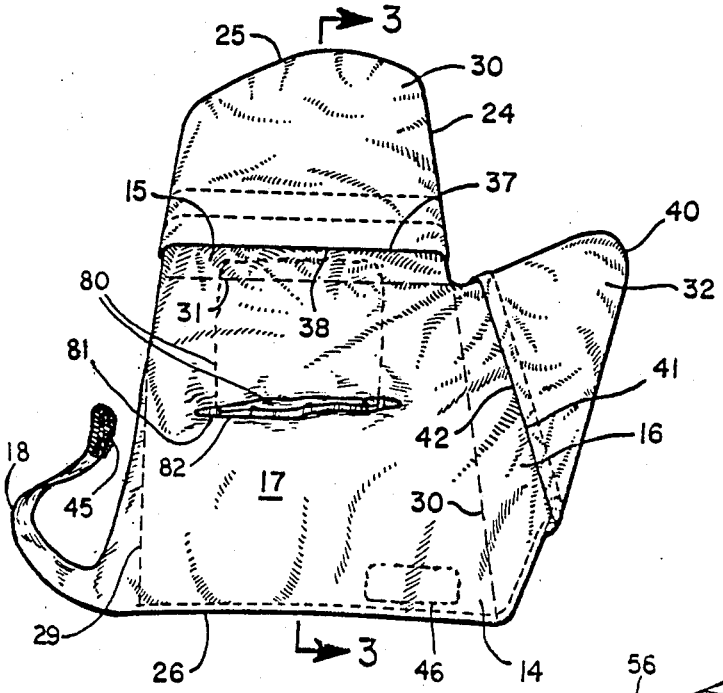
FIG. 2 is a plan view of the interior face of the subject glove covering.

The thumb section 16 begins at line 30, representing the point where the thumb meets the palm of the hand and extends to a tip end 40 of the thumb-configured projecting part of the glove shell. The remaining palm/-wrist section 17 comprises the general area within the dashed lines 29, 30, and 31. This area roughly conforms to an area slightly larger than the palm of the hand, meaning that portion of the hand not including fingers and thumb. Accordingly, the full length of the outer glove shell extends from a finger tip end 25 to a rearward wrist end 26 of the palm/wrist section. The additional structure to the left side of dashed line 29 in FIG. 2 represents a strap member 18 which is attached to the palm/wrist section 17 and extends outward therefrom to a length sufficient to wrap the wearer's wrist, as illustrated in FIG. 1. This strap member will be described in greater detail hereafter.

Figure 3:
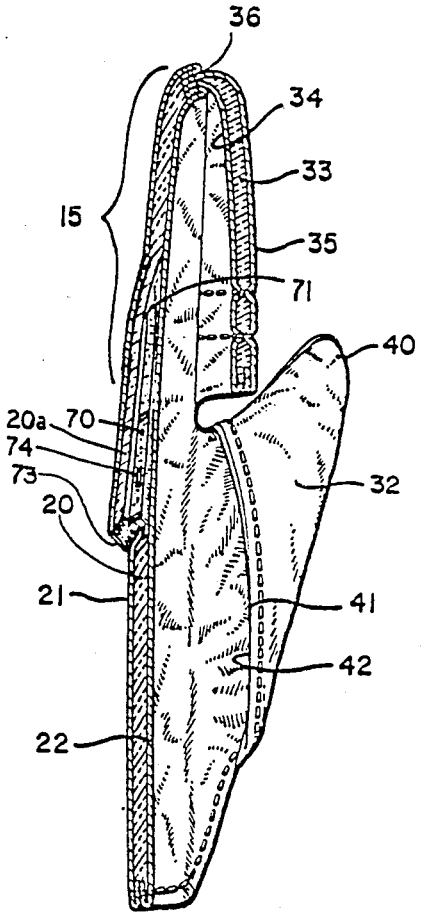
FIG. 3 is a cross section of an alternate embodiment of the subject invention taken along the orientation of lines 3—3 of FIG. 2, but having a forehand pocket instead of a palm pocket as shown in FIG. 2.

To enable the outer glove shell to be retained at the hand, and to provide further warmth and protection at the extremeties of fingers and thumb, first 30 and second 32 pocket members are attached. As illustrated in FIG. 3, the construction of the first pocket member 30 is similar to that of the outer glove shell. Specifically, it includes a thin sheet of insulation 33 which is sandwiched between opposing covering sheets of protective material 34 and 35.

This first pocket member is configured in the approximate shape of the finger section 15 and is joined at the contiguous perimeter edge 24 by stitching or other appropriate means of attachment. This point of attachment 36 is shown as a stitched or sewn construction in FIG. 3. One side of this first pocket member 37 is oriented transverse to the glove shell and is unattached thereto. Its orientation is proximate to the junction 31 of the palm/wrist and finger sections. It operates to form a pocket 38 having an opening which is accessible for the fingers from the palm/wrist section of the shell. This pocket is also referred to herein as the finger pocket of the glove covering. This pocket is shown as attached across the total periphery of the glove shell, including forward finger tip end; however, total peripheral attachment is not essential. The total attachment at the periphery will, however, provide increased protection from cold weather.

Although dimensions will generally vary because of differences in hand and glove size, typical lengths for the finger section as compared to the total length of the glove shell will generally be less than one half. More particularly, this length of fingertip section from point 25 to opening 37 will approximately be one third the total length of the shell, provided the rearward end 26 extends several inches along the wrist of the wearer.

The second pocket member 32 or thumb member is configured in the approximate shape of the thumb section 16 of the glove shell and is likewise attached at the contiguous perimeter edge 40 of these two members. Likewise, one side 41 of the second pocket member is oriented transverse with respect to the approximate juncture of the palm/wrist and thumb sections 30 and is unattached to form a pocket opening 42 which is accessible from the palm/wrist section of the shell. This pocket, also referred to as a thumb pocket receives the thumb or thumb of the ski glove, and cooperates with the finger pocket 30 to retain the glove covering over the hand or ski glove. Although not shown in cross section, the second pocket member is constructed similar to the first pocket member 30. The length of the pocket would approximately equal the typical length of the thumb of a ski glove.

The remaining palm/wrist section 17 is formed as an open face of the interior side of the outer glove shell. It provides protection to the back side of the hand or ski glove. Its position is against the back side of the glove 11 as shown in FIG. 1. The width of this palm/wrist section is sufficient to partially wrap around the hand, thumb and wrist as the thumb is brought to a closed grasp of a ski pole as shown in FIG. 1. Section **17*a* is accordingly drawn across the wrist and interior face of the hand or glove or provide additional protection against weather and snow. In the illustrated embodiment, the length of the outer shell from tip 25 to rearward end 26 is approximately equal to the width measurement of the outer shell from the tip of the thumb 40 to juncture line 29**.

Each of the embodiments shown in FIGS. 1, 2 and 3 include an additional pocket for receiving a heater pack which can be activated to generate heat to warm the glove. FIG. 3 illustrates the heater pack 70 inserted within a pocket 71 on the forehand side of the glove. The pocket 70 is formed between an inner lining of the glove 22 and the exterior face 21. The insulative interior **20*a* is positioned on an exterior side of the heat pack 71** to force heat migration to the interior of the glove.

An opening 73 is provided at one end of the pocket 71 to enable the heat pack 70 to be inserted or removed at will. Velcro ( TM ) or other fastening means (not shown) may be used at the opening 73 to secure the opening in a closed position for retaining heat within the glove. A typical procedure of use would consist of the steps of inserting a charged heat pack 70 within the pocket 71 through opening 73. The opening is then sealed with the heat pack enclosed. If used in skiing, the skier may ski until his hands begin to chill, at which point he depresses an activator button 74 within the heat pack. Such a heat pack may be secured from Reheater Inc. of Lomita, Calif. In charged condition, it is a salt solution in liquid form which is contained within a thin, flat, flexible plastic packet. The activator button releases a spark which triggers a crystalization reaction, releasing a substantial quantity of heat. When contained within the insulation of the glove, this heat continues for several hours. The heat pack can be recharged by boiling the pack with crystalized contents to its original liquid form. It may then be reinserted into the pocket for future use.

FIGS. 1 and 2 illustrate the same heat pack 80 positioned within a pocket housing 81 on the interior face of the glove. An opening 82 is provided to permit insertion and removal of the packet at will. The configuration of gloves shown in FIG. 1 provides an exterior glove 10 surrounding the interior glove 11, with the heat pack secured therebetween. Heat generated is retained around the interior glove 11, particulaly at the fingers which are most vulnerable to the cold weather.

A final section of the glove covering includes a quick attachment and release means 18. This comprises a strap member 18 which has VELCRO (TM) attachment members 45 and 46 of respective loop and hook configuration. These are shown in coupled relationship 19 in FIG. 1. These VELCRO members adapt the strap for quick release and attachment around the wearer's wrist. As used in this disclosure, strap is a broad term meaning any type of means capable of retaining the glove member around the wrist in a releasable configuration.

Figure 4:
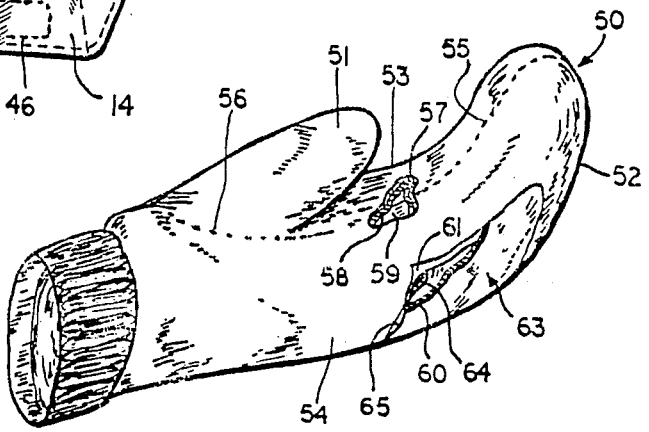
FIG. 4 is an alternate embodiment of the present invention showing a heater pocket and heater pack in a mitten configuration.

FIG. 4 discloses an alternate embodiment of the present invention. It comprises a mitten or glove 50 having an insulated thumb pocket 51 for enclosing and protecting the thumb of a hand against cold weather. A hand pocket 52 is also provided and is sufficiently large to enclose all remaining parts of the hand other than the thumb. This hand pocket including a palm side 53 and a forehand side 54 are joined together at a periphery 55 of each side. These sides are joined 56 to the thumb pocket 51 to define a single enclosure for the whole hand.

The palm side 53 of the hand pocket including an exterior 57 face exposed away from the hand and a lining member 58 between the exterior face and the interior glove cavity 59. The forehand side is similarly formed with the exterior face 60 and interior lining 61.

A heater pocket 63 is formed between the exterior face and the lining of either the palm or forehand side of the glove. This pocket provides an insert space for receiving the substantially flat, flexible, reusable heater packet 64. A pocket opening 65 is provided to permit access to the pocket for inserting the heater pack 64. This may be a product similar to that described above as item 70. The pocket 63 places the heater packet between the lining and exterior face and adjacent to the hand. When activated, the heater pack may generate heat for several hours to the interior of the glove.

Other advantages and benefits of the present inventive structure will be apparent to those skilled in the art. For example, this new glove configuration offers increased versatility for many sports without any change of structure. Fingers can be easily withdrawn for use on a bow string or trigger of a weapon. The glove may be used as a protective shell with heat source outside a ski glove to increase the warmth of the extremities and back of the hand. On warm days, the glove may be used as a single covering for the hand of the user, providing both protection on the exterior side and ventilation to the palm side of the hand. Because of the sheet-like construction of the glove covering, very little bulk is developed. This enables the glove to be inserted easily in pockets of a jacket or otherwise stored without inconvenience. In addition, it will be apparent to those skilled in the art that modifications and alterations to this general concept are foreseeable, particularly as they relate to adaptation for certain styles of gloves and ski wear. Furthermore, this glove covering may be adapted for other winter sports and applications where a person's hands need to be protected from the weather, without increasing the bulk between the hand and the object being held. Accordingly, the previous disclosure is not to be construed as limiting, except as set forth in the following claims.

I claim:

1. A glove covering for use in winter sports for protecting a hand against cold weather, said glove comprising:

an outer glove shell configured in size and shape to fully cover only a back side of the hand and including at least one finger section, a palm/wrist section and a thumb section, and having a length extending from a forward finger-tip end of the finger section to a rearward wrist end of the palm/wrist section;

at least one first pocket member configured in the approximate shape of the finger section of the glove shell and being joined therewith at contiguous perimeter edges including the forward finger-tip end of the shell, one side of the first pocket member being transverse and unattached with respect to the approximate juncture of the palm/-wrist and finger sections to form a pocket opening accessible from the palm/wrist section of the shell, thereby forming a finger pocket between the shell and the first pocket member;

a second pocket member configured in the approximate shape of the thumb section of the glove shell and being joined therewith at contiguous perimeter edges including a thumb-tip end of the shell, one side of the second pocket member being transverse and unattached with respect to the approximate juncture of the palm/wrist and thumb sections to form a pocket opening accessible from the palm/-wrist section of the shell, thereby forming a thumb pocket between the shell and the second pocket member;

the palm/wrist section further including pocket structure at a backhand side thereof for receiving a flexible, thin, heater pack.

2. A glove as defined in claim 1, wherein said outer glove shell is comprised of a layer of insulative material sandwiched between layers of attached exterior protective covering.

3. A glove as defined in claim 2, wherein the pocket structure is formed between an inner lining of the palm/wrist section and the insulative material contained therein, thereby retaining generated heat within the outer glove shell.

4. A glove as defined in claim 1, further comprising a strap member attached to the palm/wrist section on an opposing side to the juncture of the palm/wrist section and extending outward therefrom, said strap member having sufficient length to wrap around a wearer's wrist to secure the glove in place.

5. A glove as defined in claim 4, further comprising quick attachment and release means coupled to the strap member and adapting the strap member for quick release and attachment around the wrist.

6. A glove as defined in claim. 5 wherein the quick atachment and release means comprises opposing gripping faces of VELCRO( TM ) material spaced on opposing positions of the strap and exterior face of the palm/-wrist section.

7. A glove as defined in claim 1, comprising a plurality of first pocket members configured in the approximate shape of the finger section of the glove shell and being joined therewith at contiguous perimeter edges, one side of each first pocket member being transverse and unattached with respect to the approximate juncture of the palm/wrist and finger section to form a plurality of pocket openings accessible from the palm/-wrist section of the shell, thereby forming a plurality of finger pockets between the shell and the first pocket members.

8. A glove as defined in claim 1, further comprising an interior ski glove having finger and thumb enclosures and a glove body for fully enclosing the hand, said finger enclosures of the interior glove being positioned within the first pocket, said thumb enclosure being positioned within the second pocket, and a palm side of the interior glove being exposed and uncovered to permit direct grasp of an object by a wearer of the interior glove and glove covering, an exterior side of the interior glove at the back of the hand being shielded from cold weather by the outer glove shell and warmed by the heat pack contained in the pocket structure of the palm/wrist section.

9. A glove as defined in claim 1, wherein the length of the finger section of the glove is less than half the total length of the glove shell from the finger-tip to the rearward end of the palm/wrist section.

10. A glove as defined in claim 9, wherein the length of the fingertip section is approximately one-third the total length of the shell.

11. A glove as defined in claim 9, wherein the length of the outer shell approximately equals a width measurement of the outer shell.

12. A glove as defined in claim 9, wherein the palm/-wrist section of the outer shell has sufficient width extending laterally with and rearward of the thumb section to provide a partial covering to a wearer's wrist when the wearer's hand is closed to a fist configuration, the thumb section being operable to draw the extended palm/wrist section around and over the wrist.

13. A heated mitten comprising:

an insulated thumb pocket for enclosing and protecting the thumb of a hand against cold weather;

a hand pocket sufficiently large to enclose all remaining parts of the hand other than the thumb, said hand pocket including a palm side and a forehand side joined together at a periphery of each side and to the thumb pocket to define a single enclosure for the whole hand;

said palm side of the hand pocket including an exterior face exposed from the palm of the hand and a lining member between the exterior face and the palm of the hand;

said palm side of the hand pocket including an exterior face exposed from the palm of the hand and a lining member between the exterior face and the palm of the hand;

said palm side including a heater pocket formed at the exterior face to provide an insert space for receiving a substantially flat, reusable heater packet, said exterior face including a pocket opening to provide access to the pocket for inserting the heater pack, said pocket providing placement of the heater packet proximate to the palm of the hand to provide additional warmth.

14. A glove as defined in claim 13, further comprising a substantially flat, flexible, reusable heater packet positioned within the heater pocket.

15. A heated glove comprising:

an insulated thumb pocket for enclosing and protective the thumb of a hand against cold weather;

a hand pocket sufficiently large to enclose all remaining parts of the hand other than the thumb, said hand pocket including a palm side and a forehand side joined together at a periphery of each side and to the thumb pocket to define a single enclosure for the whole hand;

said palm side of the hand pocket including an exterior face exposed away from the hand and a lining member between the exterior face and the hand;

said palm side including a heater pocket formed between the exterior face and the palm side lining to provide an insert space for receiving a substantially flat, flexible, reusable heater packet, said exterior face including a pocket opening to provide access to the pocket for inserting the heater pack, said pocket providing placement of the heater packet between the lining and exterior face and adjacent to the palm of the hand.

16. A heated glove comprising:

an insulated thumb pocket for enclosing and protecting the thumb of a hand against cold weather;

a hand pocket sufficiently large to enclose all remaining parts of the hand other than the thumb, said hand pocket including a palm side and a forehand side joined together at a periphery of each side and to the thumb pocket to define a single enclosure for the whole hand;

said forehand side of the hand pocket including an exterior face exposed away from the hand and a lining member between the exterior face and the forehand side lining to provide an insert space for receiving a substantially flat, flexible, reusable heater packet, said exterior face including a pocket opening to provide access to the pocket for inserting the heater pack, said pocket providing placement of the heater packet between the lining and g exterior face and adjacent to the hand.

17. A glove as defined in claim 16, further comprising a substantially flat, flexible, reusable heater packet positioned within the heater pocket.

18. A glove as defined in claim 17, further comprising a substantially flat, flexible, reusable heater packet positioned within the heater pocket.

* * * * *